US006195817B1

(12) United States Patent
Chilton

(10) Patent No.: US 6,195,817 B1
(45) Date of Patent: Mar. 6, 2001

(54) SHOWER CURTAIN SPLASH ACCESSORY

(76) Inventor: Ralph H. Chilton, 108 N. Cove Dr., Ponte Vedra Beach, FL (US) 32082

( * ) Notice: Subject to any disclaimer, the term of this patent is extended or adjusted under 35 U.S.C. 154(b) by 0 days.

(21) Appl. No.: 09/413,952

(22) Filed: Oct. 7, 1999

(51) Int. Cl.[7] ..... A47K 3/38
(52) U.S. Cl. ..... 4/609
(58) Field of Search ..... 4/558, 608–610

(56) References Cited

U.S. PATENT DOCUMENTS

| | | | |
|---|---|---|---|
| 2,554,106 | 5/1951 | Heubeck | 160/349 |
| 2,712,345 | 7/1955 | Margolies | 160/330 |
| 3,639,919 | 2/1972 | White | 4/149 |
| 4,887,324 | 12/1989 | Cairns | 4/609 |
| 5,201,081 | 4/1993 | Knight | 4/609 |

*Primary Examiner*—Charles E. Phillips

(57) ABSTRACT

A shower curtain splash accessory having an elongated, auxiliary edge member for a shower curtain and hangar means for hanging the splash accessory from a curtain rod with the elongated edge member in a generally upright position below the rod and overlapping a leading edge section of the curtain, the edge member having a longitudinally extending front face and a longitudinally extending channel with a lateral opening, on the side or in the front face of the edge member, for inserting a leading edge part of the curtain into the channel, and retainer sleeves mounted in the channel for retaining an inserted edge part therein, the hangar means being shiftable along the curtain rod to shift the edge member and inserted curtain part between a withdrawn position permitting entrance into and egress from the shower and a forward position providing an effective splash barrier.

18 Claims, 6 Drawing Sheets

SHOWER CURTAIN SPLASH ACCESSORY

FIELD OF THE INVENTION

The present invention relates to shower curtain accessories for preventing splashing water from escaping between the shower curtain and shower wall. More specifically, the present invention relates to splash accessories of the type hung from and shiftable along a shower curtain rod and having an auxiliary edge member adapted to cooperate with a leading edge section of the shower curtain to provide a splash barrier at the shower wall.

SUMMARY OF THE INVENTION

A principal object of the present invention is to provide in a splash accessory of the type described, a new and improved auxiliary edge member adapted to be attached to the shower curtain in a new and improved manner to provide an effective splash barrier at the shower wall.

Another object of the present invention is to provide in a splash accessory of the type described, a new and improved auxiliary edge member having an elongated channel for attaching a leading edge part of the shower curtain to the edge member so that the leading edge part hangs adjacent the shower wall when the edge member is next to the shower wall. In accordance with this object, the leading edge part of the curtain can be attached to the edge member by being tucked into the channel or securely held in the channel by separate connectors.

Another object of the present invention is to provide a new and improved splash accessory of the type described which can be easily shifted along the curtain rod to position the auxiliary edge member next to and in engagement with the shower wall to provide a splash barrier at the shower wall, or withdrawn from the shower wall to provide an opening for entrance into and egress from the shower.

Another object of the present invention is to provide a new and improved splash accessory of the type described which can be easily installed and which can be used with conventional shower curtains in bathtub and other types of shower enclosures, all without modification, and with the shower curtain on either the right-side or left-side of the shower or inside or outside of the splash accessory.

Another object of the present invention is to provide a new and improved splash accessory of the type described, having an economical and attractive design, having a rigid and durable construction primarily employing sheet and/or extruded plastic parts and which can be easily cleaned and maintained.

Other objects will become apparent from the following detailed description and accompanying drawings.

DETAILED DESCRIPTION OF PREFERRED EMBODIMENTS

Figure 1:
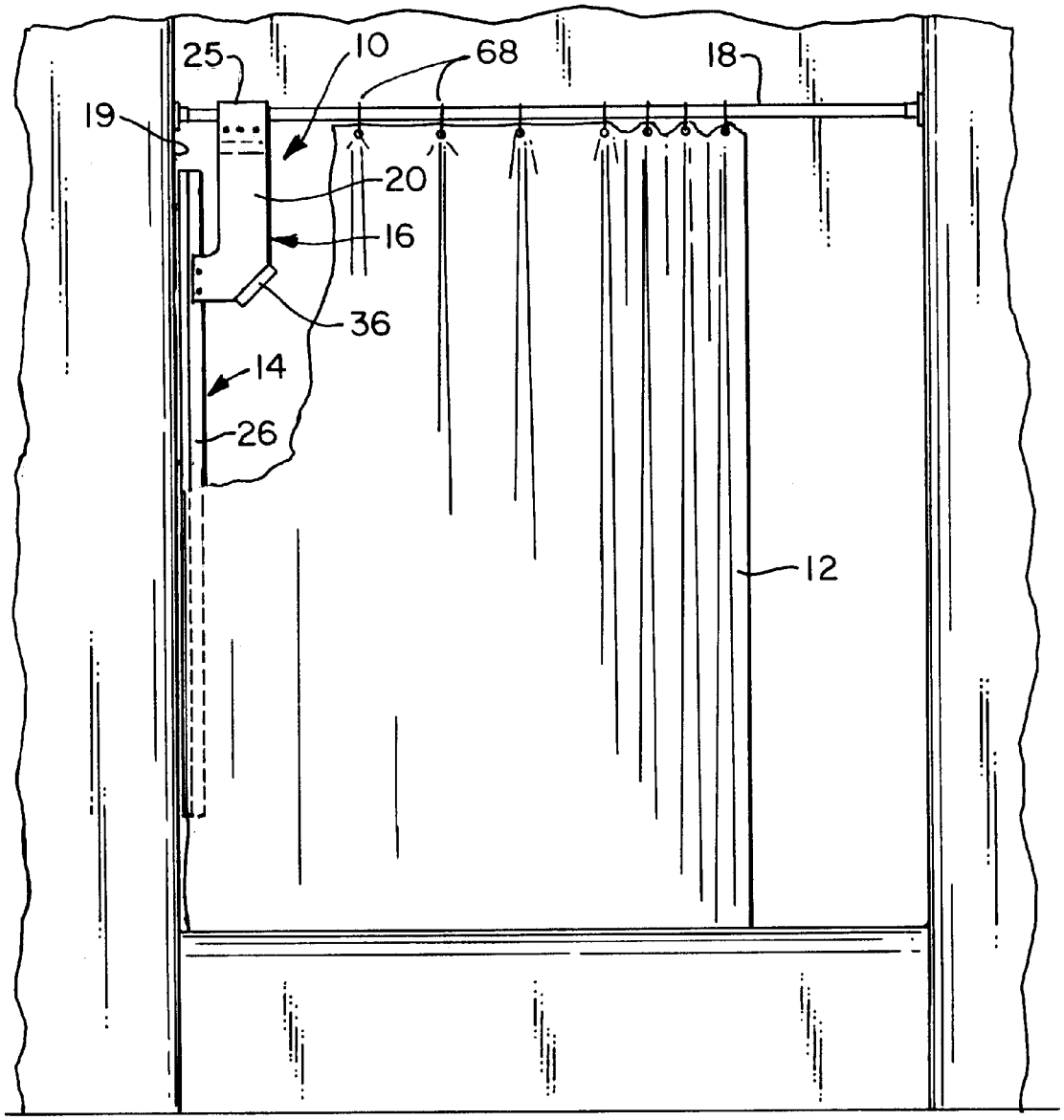
FIG. 1 is a side elevation view showing a shower curtain splash accessory incorporating the present invention installed in a bathtub type shower enclosure.
Figure 2:
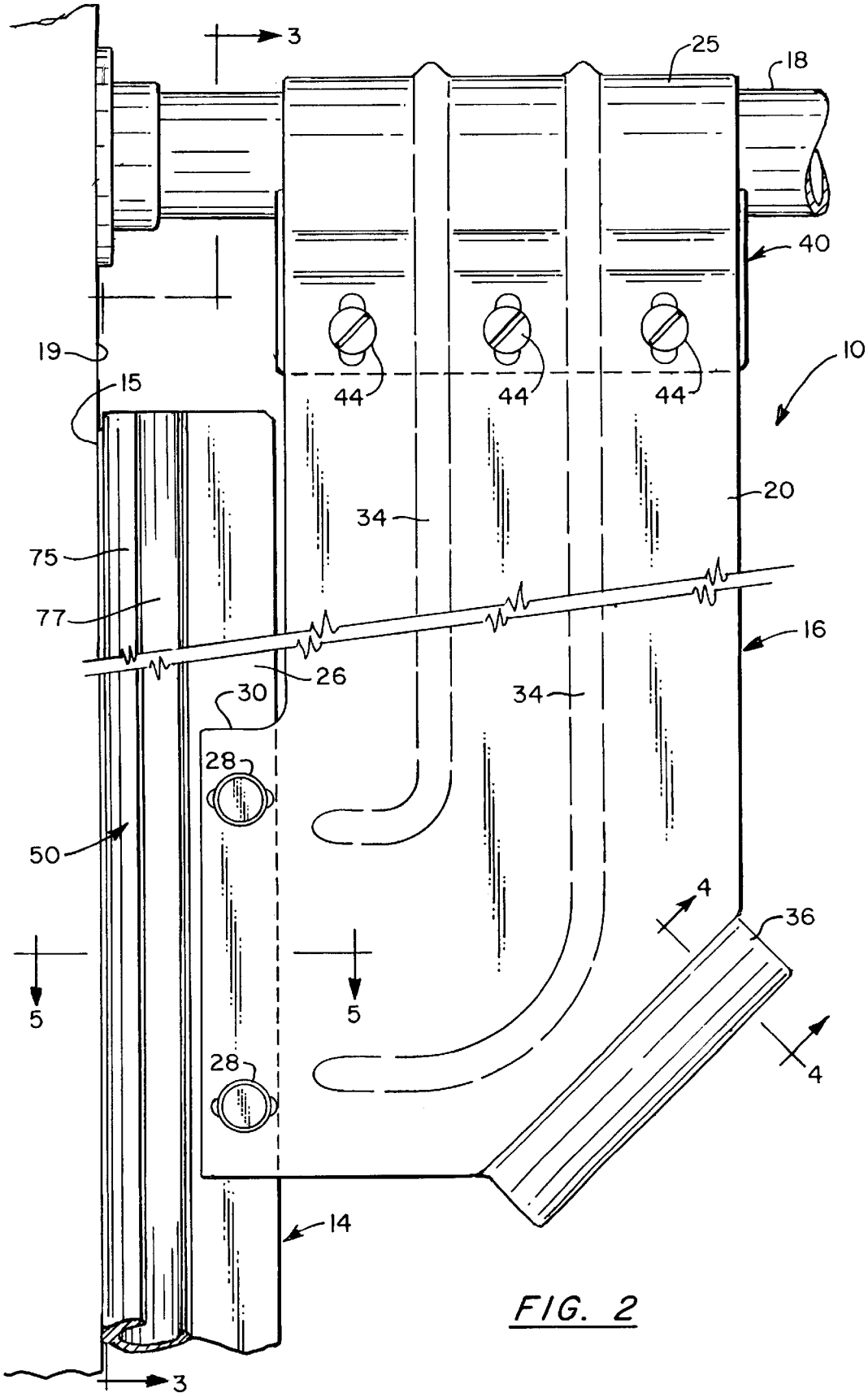
FIG. 2 is an enlarged partial side elevation view of the installation of FIG. 1, showing the splash accessory in greater detail.
Figure 3:
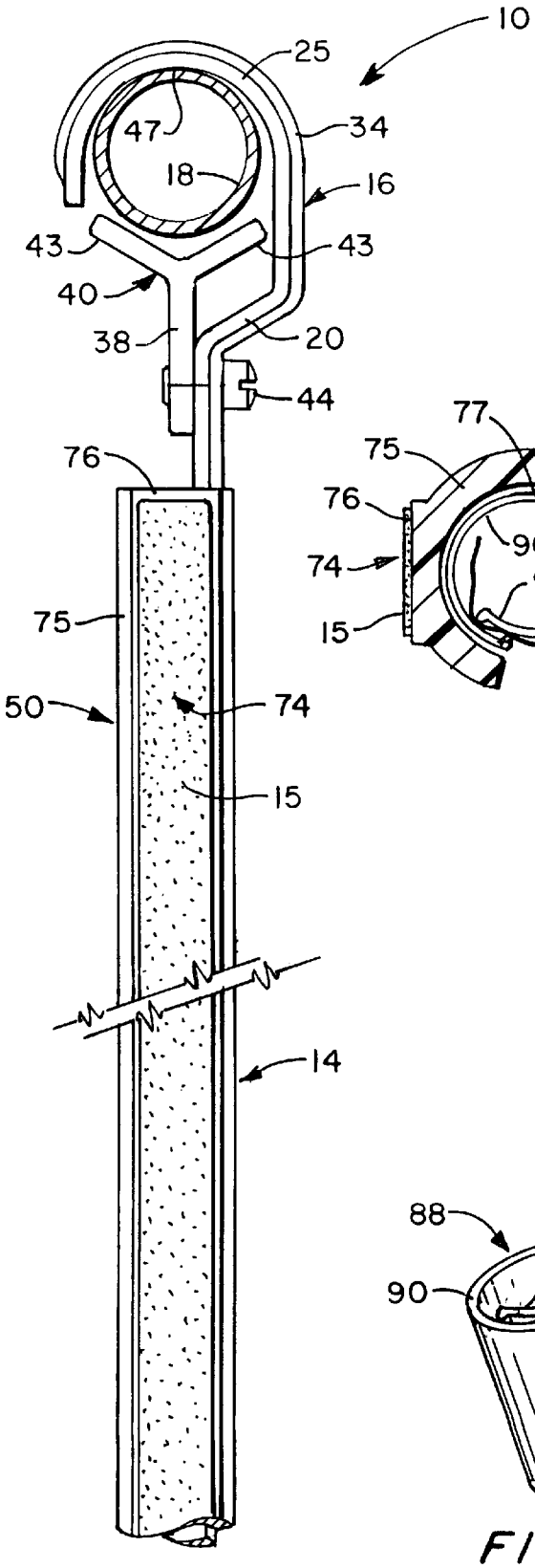
FIG. 3 is an elevation section view of the installation of FIG. 1, taken generally along line 3—3 of FIG. 2.
Figure 4:
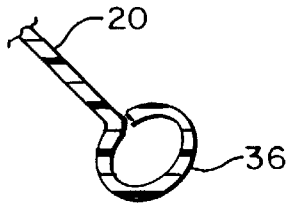
FIG. 4 is a section view, taken generally along line 4—4 of FIG. 3, showing a handle of the splash accessory.
Figure 5:
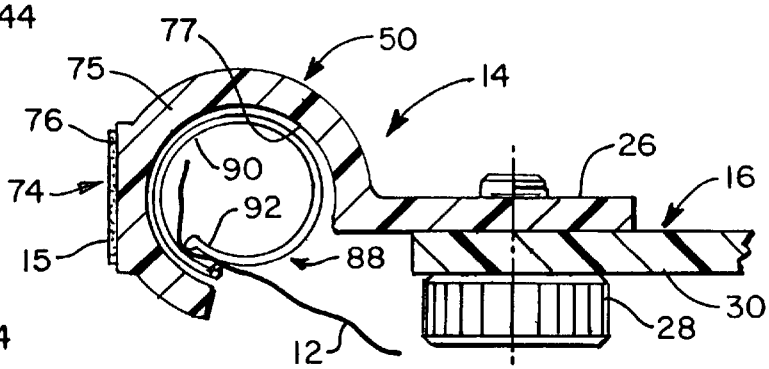
FIG. 5 is an enlarged transverse section view of the splash accessory, taken generally along line 5—5 of FIG. 2, also showing a leading edge part of a shower curtain of the shower enclosure.
Figure 6:
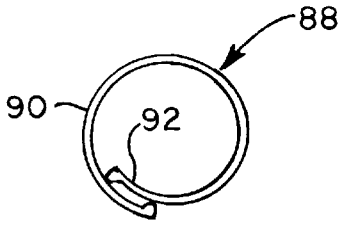
FIGS. 6 and 7 are end and perspective views of a connector sleeve of the splash accessory.
Figure 7:
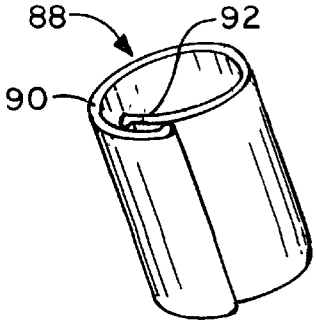
Figure 8:
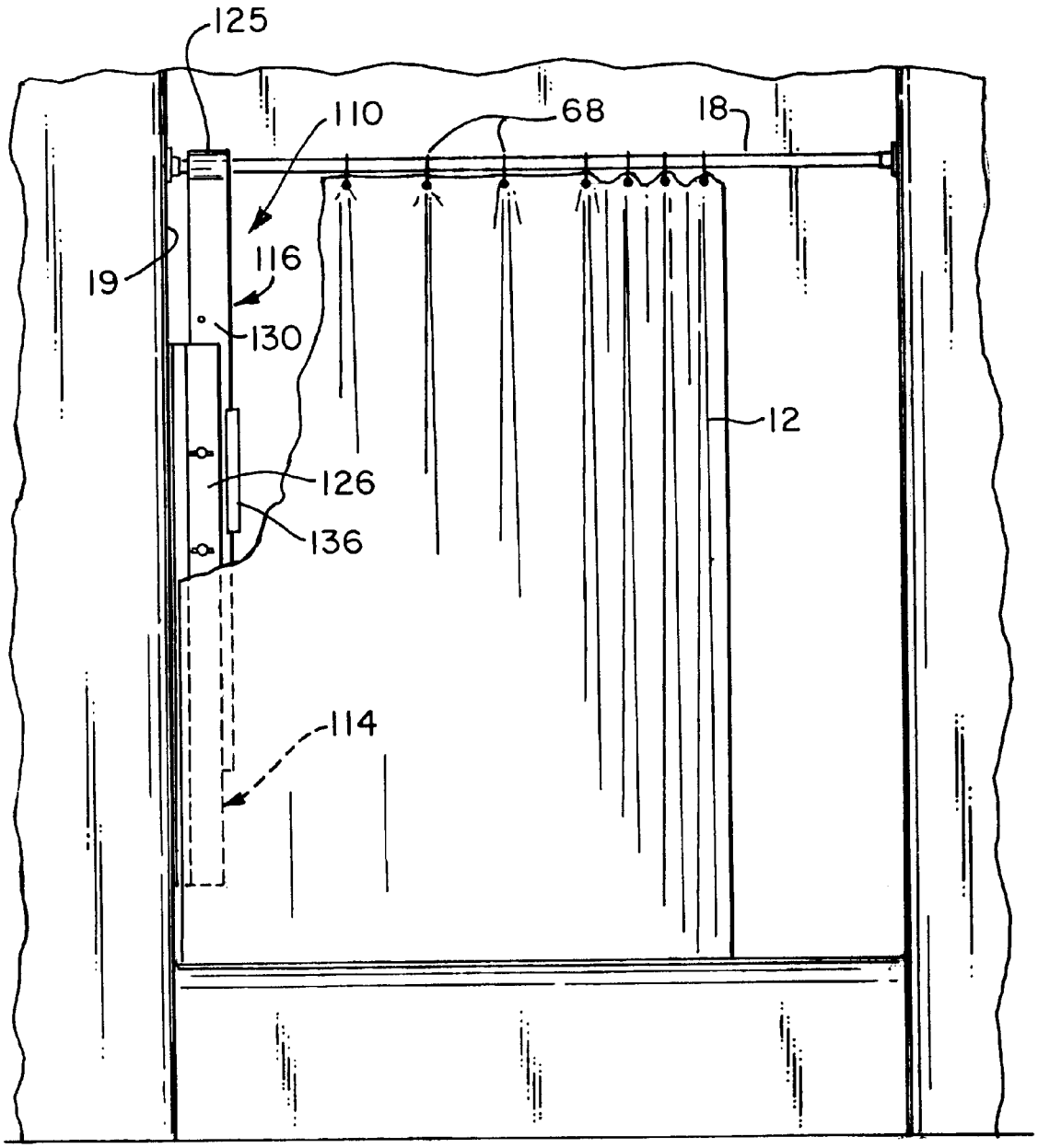
FIG. 8 is a side elevation view, generally like FIG. 1, showing a modified splash accessory incorporating the present invention installed in the shower enclosure.
Figure 9:
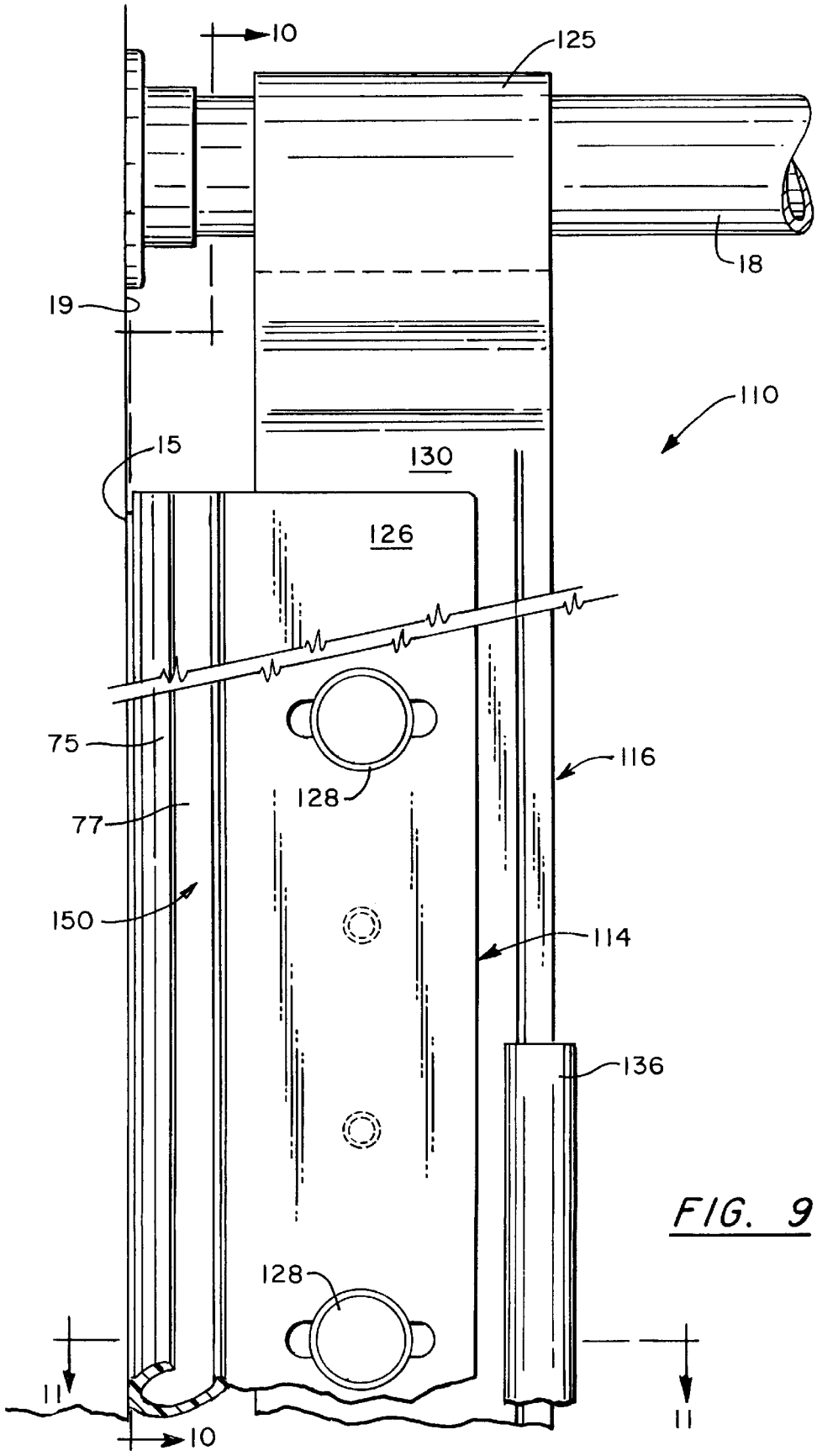
FIG. 9 is an enlarged partial side elevation view of the installation of FIG. 8, showing the modified splash accessory in greater detail.
Figure 10:
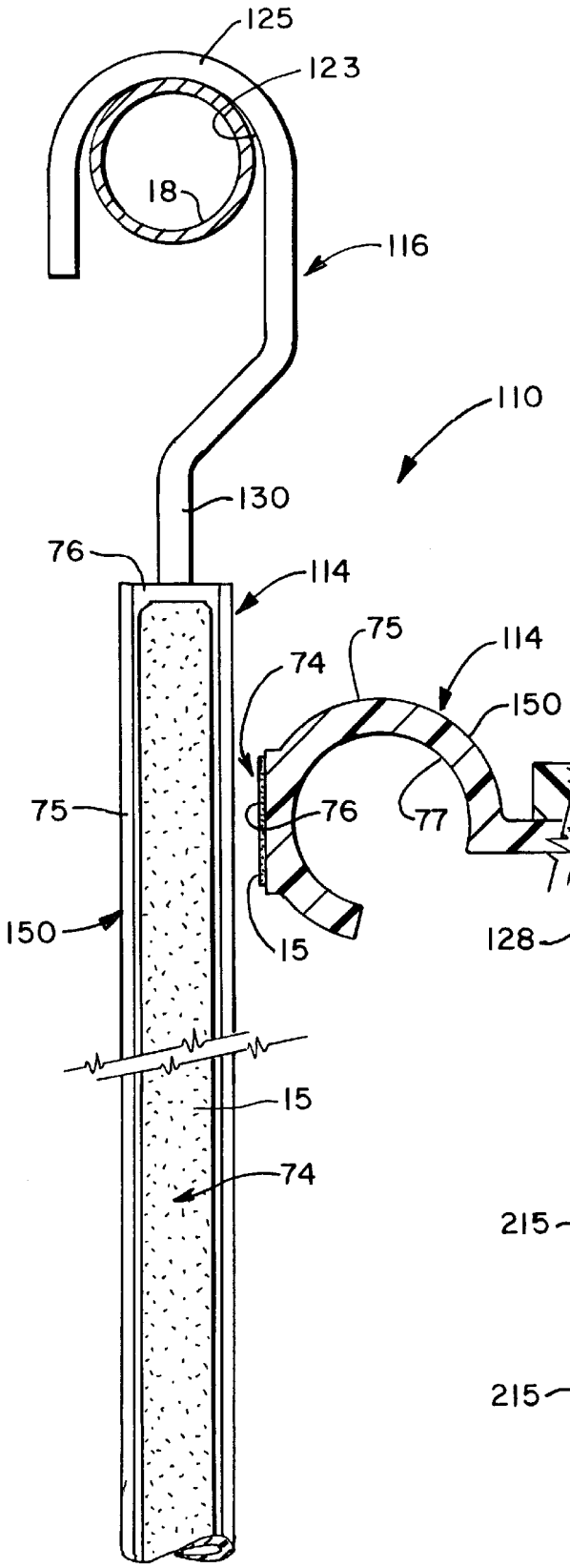
FIG. 10 is an elevation section view of the installation of FIG. 8, taken generally along line 10—10 of FIG. 9.
Figure 11:
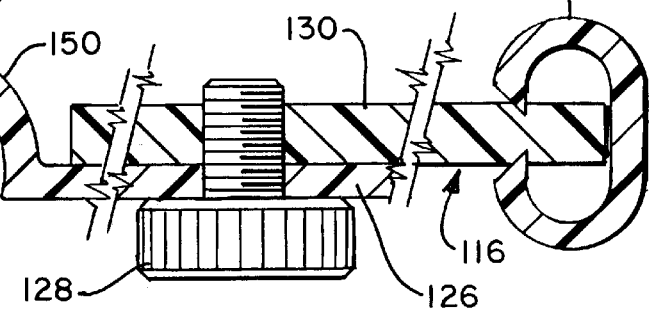
FIG. 11 is an enlarged transverse section view of the modified splash accessory, taken generally along line 11—11 of FIG. 9.

In the drawings, like reference numerals identify like parts.

A shower curtain splash accessory 10 incorporating the present invention is shown in FIGS. 1–7. The splash accessory 10 is shown installed in a bathtub type shower enclosure having a shower curtain 12 suspended from a horizontal curtain rod 18. The splash accessory 10 provides an auxiliary edge member 14 for the curtain 12 and has a hangar 16 for hanging the edge member 14 from the rod 18 in a generally upright position below the rod 18 and within the shower curtain opening. The hangar 16 is manually shiftable along the curtain rod 18 to position a front face 15 of the edge member 14 next to and against (preferably flat against) or withdrawn from an opposed shower wall 19 at one end of the curtain opening.

The hangar 16 comprises an elongated, rigid bracket 20 formed from a flat sheet or blank of plastic. The bracket 20 has an upper collar or hook 25 for hanging the splash accessory 10 from the curtain rod. The collar 25 has an inner, semi-cylindrical seat 23 with a radius slightly greater than the radius of the curtain rod 18 to facilitate movement of the hangar 16 along the rod 18.

The edge member 14 is supported, by a pair of transverse fasteners 28, on a lower front extension 30 of the bracket 20. The fasteners 28 are mounted in aligned openings in the bracket 20 and in a flat rear fin or splash shield 26 of the edge member 14. One of the bracket openings is elongated to permit the edge member 14 to be inclined relative to the bracket 20. A wedge (not shown) may be mounted between the fin 26 and extension 30 to position the lower end of the edge member 14 inward of the vertical plane of the curtain rod axis when the splash accessory 10 hangs freely from the curtain rod 18. Instead, if desired, the hangar 16 can be swung inwardly slightly when positioning the edge member 14 against the opposed shower wall 19.

The bracket 20 preferably has a length of about 15 to 18 inches and a generally constant (e.g., 4 inch) width from its upper free end to its lower front end 30. Suitable ribs 34 are provided to give the bracket rigidity. An integral handle 36 with approximately a 45 degree backward inclination is provided at the lower rear edge of the bracket 20 to facilitate manually positioning the hangar 16 on the rod 18.

The bracket 20 has a flat side to which the rear fin 26 and a support flange 38 of a lower collar 40 are secured. The collar 40 has a symmetrical, generally Y-shape with two flat, laterally upwardly and outwardly inclined pads 43 engageable with the bottom surface of the curtain rod 18. The pads 43 help guide the hangar and help resist hangar movement along the rod 18, most importantly when the edge member 14 is positioned with its front face 15 against or next to the opposed shower wall 19. The included angle between the flat pads 43 (e.g., 120 degrees) is selected to provide adequate resistance to unintended hangar movement and yet permit easy manual hangar movement along the rod 18.

The collar support flange 38 has three elongated fastener openings, for three fasteners 44, for vertically and angularly positioning the collar pads 43 in accordance with the diameter of the curtain rod 18, the (normally backward) inclination of the upright edge member 14 relative to the bracket 20 and the desired collar resistance. The weight of the splash accessory 10 biases the pads 43 upwardly, about a front pivot edge 47 of the collar seat 23, against the curtain rod 18. The pads thereby establish the angle at which the splash accessory 10 hangs from the curtain rod 18. The edge member 14 and lower collar 40 are mounted so that the edge member 14 can be manually positioned with its front face 15 flat against the shower wall and frictionally held in that position by the opposed collar parts 43, 47.

The edge member 14 preferably extends upwards from the bracket extension 30 about 6 to 12 inches and downwards from the extension 30 about 12 to 48 inches, both depending on the configuration of the shower enclosure, height of the curtain rod 18 and manner of use of the edge member 14. A line of fastener openings are provided on the rear fin 26 to vertically position the edge member on the bracket 20 as desired.

A modified splash accessory 110, shown in FIGS. 8–11, incorporating the present invention, comprises an auxiliary edge member 114 and an elongated extruded plastic hangar 116. The hangar 116 is preferably about 3 inches wide and has an upper collar or hook 125 for hanging the splash accessory 110 from the curtain rod. A flat depending strap 130 supports the edge member 114, serves as a counterweight for the edge member, and may serve as a splash shield. An elongated, extruded plastic handle 136 is mounted on the rear end of the strap 130. The handle 136 is used to manually position the splash accessory 1 10 on the curtain rod 18 and also serves as a counterweight for the edge member 114. The depending strap 130 may be relatively short, only long enough to support the edge member 114, or may be much longer and even extend the full length of the edge member 114. The edge member 114 has a wide rear fin or splash shield 126 secured to the strap 130 by threaded fasteners 128 mounted in slot openings in the rear fin 126 and selected threaded openings in the strap 130. A line of threaded openings are provided in the strap 130 to vertically position the edge member 114 as desired. The slot openings permit the edge member to be inclined and laterally adjusted relative to the strap 130 for hanging the splash accessory 110 from the curtain rod with its front face 15 flat against the opposed shower wall. The weight of the splash accessory 110 biases the semi-cylindrical seat 123 of the collar 125, along its entire length, against the curtain rod 18. If desired, a lower collar 40 (not shown) or other similarly functioning means can be provided on the hangar 116 as on the hangar 16.

One or two conventional curtain rings 68 are mounted on the curtain rod 18 in front of the hangar 16, 116 for the first one or two eyes of the curtain 12. A leading edge section of the curtain 12 is therefore held in overlapping relationship with the edge member 14, 114 and is shifted along the curtain rod 18 by and with the hangar 16, 116.

Two slightly different auxiliary edge members 14, 114 are used in the two splash accessories 10, 110. Each edge member 14, 114 comprises a rigid plastic extrusion 50, 150 with a front section 75 with a relatively wide, flat or slightly convex, front surface 76 and a strip 74 of resilient material on the front surface 76 to increase the contact area and friction between the edge member 14, 114 and shower wall when the edge member is positioned flat against the wall. The added friction helps hold the edge member against sideways movement on the wall (e.g., when the edge member is swung inwardly slightly about the curtain rod 18). In an alternative design, the strip 74 is not provided and a concave groove (not shown) is provided in the front surface to conduct water downwardly.

Figure 12:
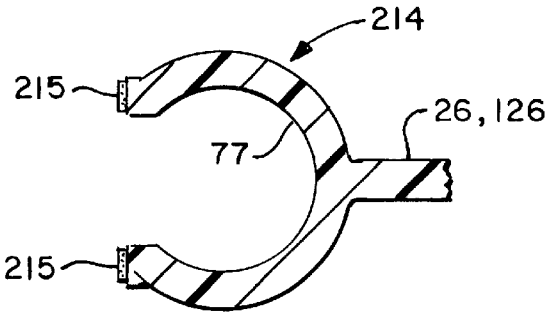
FIG. 12 is a partial transverse section view of a modified auxiliary edge member for the splash accessories.

Each edge member extrusion 50, 150 has an elongated channel 77, with a circular cross section, immediately behind the front face 15 for receiving a leading edge part of the shower curtain. In the extrusions 50, 150, the front channel 77 has a lateral opening of about 90 degrees on one side of the edge member. In a modified edge member 214, shown in FIG. 12, the front channel 77 of the extrusion has a 90 degree lateral opening in the front face between two spaced front edges 215 forming the front face.

A leading edge part of the curtain is held within the channel 77 by short connectors or slides 88 having outer rings or sleeves 90 dimensioned to be loosely retained (or in the alternative, firmly retained) in the channel 77. Each connector 88 has an internal, integral leaf spring 92 which cooperates with the outer sleeve 90 to provide a narrow opening or throat for inserting the front edge of the curtain into the sleeve 90 and to lightly clamp the inserted curtain part against withdrawal. Each curtain mounted connector 88 can be easily inserted into and removed from the channel 77 through the lateral channel opening (by compressing the sleeve 90) or through either end of the channel 77. Also, with some curtains, it is expected that a leading edge part of the curtain can be tucked into the channel 77 in such a way that the curtain will remain in the channel 77 without using connectors 88.

When the edge member 14, 114, 214 is positioned with its front face 15, 215 flat against or next to the shower wall, a leading edge part of the curtain will hang from the lower end of the channel 77 adjacent the wall. If desired, the curtain can hang free on the side (preferably outside) of the edge member, overlapping the edge member but not attached to the edge member by the connectors 88 or by tucking the curtain into the channel 77. The edge member is then used only as a splash shield instead of as both a splash shield and device for positioning a leading edge part of the curtain next to the shower wall. When used only as a splash shield, the edge member preferably has a wide (e.g., 2 or 3 inch wide) splash fin 26, 126 and extends to or near the bottom of the shower curtain opening (and when used in a bathtub type shower, has a depending skid (not shown) mounted in the channel 77 for engagement with the top of the bathtub).

Each of the described embodiments can be used with a right-sided shower curtain (where the curtain is on the right side of a person standing in the shower enclosure facing the shower) or with a left-sided shower curtain (as shown in the drawings). Each splash accessory 10, 110 is shown mounted on the inside of the curtain, but, if desired, can be mounted on the outside of the curtain. To modify the splash accessory 10, 110 for use on the opposite side of the curtain or shower enclosure, the upright edge member 14, 114 is reversed end-for-end on the hangar 16, 116. Such modification is not required when using the edge member 214.

While preferred embodiments of the invention are shown in the drawings and described above, other forms of the invention could be adopted without departing from the scope of the invention, which is set forth in the following claims.

I claim:

1. A shower curtain splash accessory for a shower curtain suspended from a curtain rod within a shower curtain opening and shiftable on the curtain rod to suspend a leading edge section of the curtain adjacent to an opposed shower wall at one end of the shower curtain opening; the splash accessory comprising an elongated, auxiliary edge member, and hangar means for hanging the splash accessory from the curtain rod with the elongated edge member hanging in a generally upright position below the curtain rod and overlapping a leading edge section of the curtain, the edge member having a longitudinally extending front end and a longitudinally extending channel adjacent to the front end for positioning a leading edge part of the curtain adjacent to the front end, the channel having a narrow, longitudinally extending, lateral opening providing unblocked lateral access to the channel along the full length of the channel for manually inserting a leading edge part of the curtain into the channel along the full length of the channel and manually withdrawing the inserted curtain part from the channel, both while the edge member is hanging from the curtain rod, the hangar means having a depending edge member support, the edge member and edge member support having cooperating means for supporting the edge member on the depending support and permitting longitudinal adjustment of the edge member relative to the depending support, the hangar means being manually shiftable along the curtain rod to shift the edge member, with a said inserted curtain part within the channel, between a withdrawn position withdrawn from the opposed shower wall and a forward position with the front end of the edge member next to the opposed shower wall.

2. A splash accessory according to claim 1, wherein the hangar means comprises collar means for receiving the curtain rod and engageable with the curtain rod to hold the edge member in a forward position with its front face flat against the shower wall.

3. A splash accessory according to claim 1, wherein the edge member has a plurality of separate, longitudinally spaced retainers mounted along the channel for retaining a said inserted curtain part within the channel.

4. A splash accessory according to claim 1, wherein said lateral opening is on one side of the edge member and faces away from the front end.

5. A splash accessory according to claim 1, wherein the edge member has a plurality of channel slides, each comprising a sleeve mounted within the channel and having a lateral opening for receiving a said inserted curtain part and attachment means within the sleeve for attaching a said inserted curtain part to the slide.

6. A splash accessory according to claim 1, wherein the hangar means has upper and lower collar parts for engaging the top and bottom surfaces of the curtain rod respectively, and means for adjusting the position of the lower collar part relative to the upper collar part.

7. A splash accessory according to claim 1, wherein said lateral opening is in the front face of the edge member.

8. A shower curtain splash accessory comprising an elongated, auxiliary edge member with a longitudinally extending front end, hangar means for hanging the splash accessory from a shower curtain rod with the edge member hanging in a generally upright position below the curtain rod, the edge member having attachment means for manually attaching a leading edge part of a shower curtain to one side of the edge member rearward of the front end to form therewith a combined splash accessory and for manually detaching the leading edge part from the edge member, both while the edge member is hanging below the curtain rod, the hangar means having a depending edge member support, the edge member and edge member support having cooperating means for supporting the edge member on the depending support and permitting longitudinal adjustment of the edge member relative to the depending support, the hangar means being shiftable along the curtain rod to shift said combined splash accessory between a withdrawn position withdrawn from an opposed shower wall at one end of a shower curtain opening and a forward position with the front end of the edge member next to the opposed shower wall.

9. A splash accessory according to claim 8, wherein the hangar means is swingable on the curtain rod to swing the edge member inwardly about the curtain rod and is shiftable along the curtain rod to position the front end of the edge member against the shower wall, and wherein the front end has a resilient surface to assist in holding the edge member against sideways movement on the shower wall.

10. A splash accessory according to claim 9, wherein the edge member has a resilient strip on the front end providing a front end face engageable with the opposed shower wall.

11. A splash accessory according to claim 8, wherein said attachment means comprises a longitudinally extending channel in the edge member immediately behind the front end and having a longitudinally extending lateral opening on one side of the edge member facing away from the front end and providing unblocked lateral access to the channel along the fill length of the channel for inserting a leading edge part of the curtain into the channel.

12. A splash accessory according to claim 8, wherein the attachment means comprises a plurality of separate, longitudinally spaced, retainers mounted along the channel for retaining a said inserted curtain part within the channel.

13. A splash accessory according to claim 12, wherein each retainer comprises a ring part received within the channel and a clamping part for clamping the ring part onto the curtain.

14. A shower curtain splash accessory for a shower curtain suspended from a curtain rod within a shower curtain opening and shiftable along the curtain rod to suspend a leading edge section of the curtain adjacent to an opposed shower wall at one end of the shower curtain opening; the splash accessory comprising an elongated, auxiliary edge member, and hangar means for hanging the splash accessory from the curtain rod with the edge member hanging in a generally upright position below the curtain rod and with a leading edge section of curtain on one side of the edge member; the edge member having a longitudinally extending, front end and a wide front to rear, longitudinally extending splash shield, rearward of the front end, extending longitudinally the full length of the edge member; the hangar means having a depending edge member support the splash shield and edge member support having cooperating means for supporting the edge member on the depending support and permitting longitudinal adjustment of the edge member relative to the depending support; the hangar means being shiftable along the curtain rod to position the edge member with its front end next to the opposed shower wall and with a leading edge section of curtain in overlapping relationship with the splash shield on at least one side of the edge member.

15. A splash accessory according to claim 14, wherein the splash shield has a front to rear width of at least 2 inches.

16. A splash accessory according to claim 14, wherein the hangar means is shiftable along the curtain rod to position the edge member with its front end against the opposed shower wall, and wherein the hangar means has upper and lower collar parts for engaging the top and bottom surfaces of the curtain rod respectively, and means for adjusting the inclination of the edge member so that it can be positioned with its front end against the shower wall.

17. A splash accessory according to claim 16, wherein the lower collar part has a pair of upwardly and outwardly inclined collar pads engageable with the bottom surface of the curtain rod.

18. A splash accessory according to claim 16, wherein the upper collar part loosely receives the curtain rod for hanging the splash accessory from the curtain rod and wherein the lower collar part is adjustable.

* * * * *